United States Patent [19]

Powell et al.

[11] 4,010,521

[45] Mar. 8, 1977

[54] MEANS FOR RETAINING ARTICLES

[75] Inventors: Emlyn John Powell, Salisbury; James Strathearn Brown, Darwendale, both of Rhodesia

[73] Assignee: James Strathearn Brown, Darwendale, Rhodesia

[22] Filed: July 14, 1975

[21] Appl. No.: 595,431

[52] U.S. Cl. ..... 24/258

[51] Int. Cl.[2] ..... A44B 21/00

[58] Field of Search ..... 223/96; 294/5.5; 24/243 R, 255 T, 248 B, 248 L, 258; 211/124

[56] References Cited

UNITED STATES PATENTS

| | | | |
|---|---|---|---|
| 421,127 | 2/1890 | Edwards | 294/5.5 |
| 696,005 | 3/1902 | Carey | 24/258 X |
| 721,615 | 2/1903 | Smith | 24/255 T X |
| 791,142 | 5/1905 | Farrell | 223/96 |
| 1,322,648 | 11/1919 | Sullivan | 294/5.5 |
| 2,209,864 | 7/1940 | Warren | 223/96 |
| 2,413,798 | 1/1947 | Strassburg | 223/96 |
| 2,727,662 | 12/1955 | Maloof | 223/96 |

*Primary Examiner*—Donald Griffin
*Attorney, Agent, or Firm*—Young & Thompson

[57] ABSTRACT

A device for retaining reaped hands of tobacco leaves has two co-operating members formed from a length of spring steel wire bent back on itself. The hands of tobacco leaves are placed between the members which are gripped together by clips which are slidably mounted on one of the members. The clips can be engaged with the other member by a turning action, and can be disengaged by turning them in the opposite direction.

6 Claims, 5 Drawing Figures

MEANS FOR RETAINING ARTICLES

This invention relates to a device for retaining articles. In particular it relates to a device suitable for suspending tobacco leaves during the reaping and curing processes.

The reaping of tobacco normally entails charging supports with hands of tobacco leaves which have been removed from the plant. According to this arrangement the leaves are suspended by their butts from the supports. The charged supports are then taken to a centre for curing purposes. It is, of course, essential that the supports can take up the shrinkage which occurs in the tobacco butts during this process to ensure that the tobacco leaves do not fall out.

The device of the present invention fulfils these requirements and is both simple and cheap to make.

A device for retaining articles according to the invention includes at least two co-operating elongated members and means to clamp the members together at zones spaced along their length thereby gripping the articles interposed the members between the zones.

Preferably, the device includes a pair of members in the form of a length of wire bent back on itself. In a further preferred form of the invention the clamping means is at least one clip mounted on one member and adapted releasably to engage another or the other member. In this form of the invention each clip is slideable along the length of the member on which it is mounted.

The invention will now be described by way of example only with reference to the accompanying drawings in which.

Figure 1:
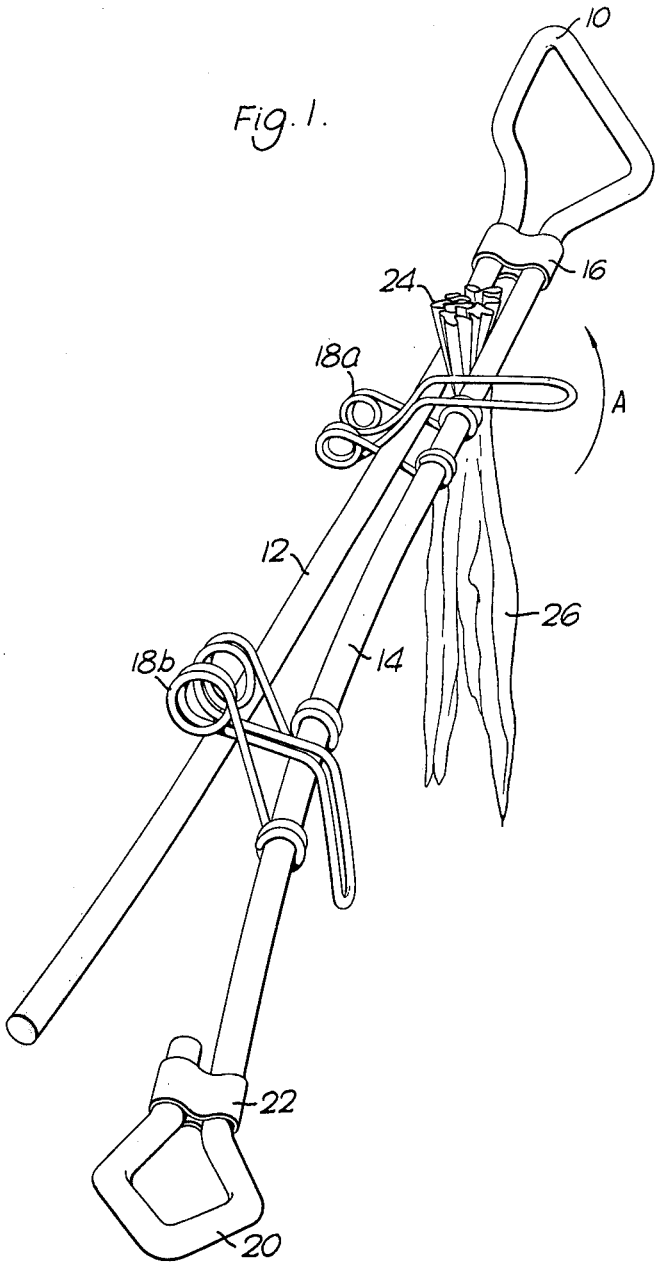
FIG. 1 illustrates a device suitable for retaining tobacco leaves.
Figure 2:
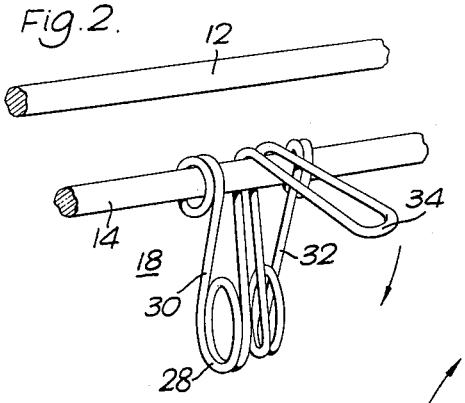
FIGS. 2, 3, 4 and 5 illustrate a clip for clamping together two elongated members in different positions of operation.
Figure 3:
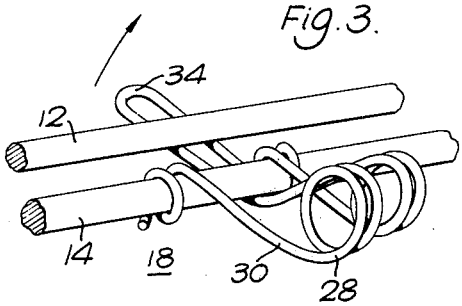

In FIG. 1 a length of spring steel wire has been bent back on itself at 10 to form a pair of opposing members 12 and 14 which are held together in the zone of the bend by means of a band 16. A number of clips, only two of which are shown in this drawing and designated 18*a* and 18*b* respectively, are slidably mounted on the member 14. The free end of the member 14 is bent back on itself at 20 and held by a band 22 to ensure that the clips 18*a* and 18*b* are retained thereon.

Referring now to FIGS. 2, 3, 4 and 5 it will be noted that each clip 18 includes a torsion spring 28, the extremities of which extend substantially tangentially in the same plane to form two arms 30 and 32 the free ends of which encircle the member 14. A hook 34 which is integral with the spring 28 extends outwardly from a point between its extremities.

Figure 4:
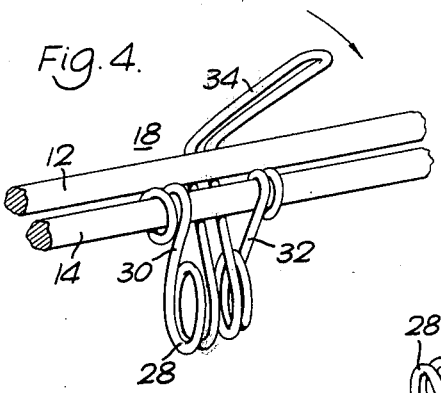
Figure 5:
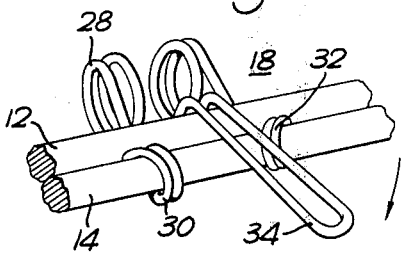

In practice the device illustrated in FIG. 1 is charged by first interposing the butts 24 of a reaped hand of tobacco leaves 26 between the members 12 and 14 adjacent the band 16. At this stage the clips are disengaged (see clip 18*b* in FIG. 1 and FIG. 2) and are positioned at the end of the member 14 adjacent the band 22 (see FIG. 1). The operator then draws the ends of the members 12 and 14 together and rotates the clip nearest to the butts 24 as indicated progressively by the arrows in FIGS. 2, 3 and 4 until it adopts the clamping position illustrated in the last mentioned Figure. If required the clip may be further rotated from the position illustrated in FIG. 4 to a second more secure clamping position as shown in FIG. 5 and by the clip 18*a* in FIG. 1. The operator then slides the clip in one of its clamping positions along the members 12 and 14 until it is adjacent the butts 24 of the tobacco leaves 26. The next hand of reaped tobacco leaves (not shown) is then interposed the members 12 and 14 adjacent the clip 18*a* in FIG. 1 and the members 12 and 14 are again drawn together by the operator and the clip 18*b* is rotated in the manner previously described until it adopts one of the clamping positions as shown in FIGS. 4 or 5. The operator then slides this clip along the members 12 and 14 until it is adjacent this second hand of tobacco. By these steps zones spaced along the length of the members 12 and 14 are clamped together thereby gripping the butts of the hands of the tobacco leaves which have been interposed the members between the zones. These operations are repeated until the device is charged with hands of tobacco leaves.

After curing, the tobacco leaves can simply be released from the device by rotating the clips in the direction illustrated by the arrow A adjacent the clip 18*a*.

As will be appreciated, the length of the device and the number of clips mounted thereon can be varied according to requirements.

We claim:

1. A device for retaining articles comprising at least two co-operating elongated members and at least one clip formed from a torsion spring having:

a. at least one outwardly extending arm the free end of which is mounted on one member, and b. an outwardly extending hook adapted releaseably to engage another or the other member against the torque of the spring thereby gripping the article interposed the members.

2. The device as claimed in claim 1 in which the or each arm is slidable along the length of the member on which it is mounted.

3. The device as claimed 1 in which the two extremities of the torsion spring forming each clip extend outwardly substantially tangentially in the same plane to form two arms mounted on one of the members and in which the hook is integral with the spring at a point between its extremities.

4. A clip for clamping together two or more co-operating elongated members comprising a torsion spring having at least one outwardly extending arm the free end of which is adapted to be mounted on one member and an outwardly extending hook adapted releasably to engage with another or the other member against the torque of the spring.

5. The clip as claimed in claim 4 in which the or each arm is slidable along the length of the member on which it is mounted.

6. The clip as claimed in claim 4 in which the extremities of the torsion spring extend outwardly substantially tangentially in the same plane to form two arms adapted to be mounted on the member and the hook is integral with the spring at a point between its extremities.

* * * * *